United States Patent [19]

Martin

[11] 3,968,356

[45] July 6, 1976

[54] LIGHTED KNOB DIMMER

[75] Inventor: Robert L. Martin, Cranston, R.I.

[73] Assignee: General Electric Company, New York, N.Y.

[22] Filed: June 14, 1974

[21] Appl. No.: 479,391

[52] U.S. Cl. ..... 240/2 S; 200/310

[51] Int. Cl.[2] ..... F21V 33/00

[58] Field of Search ..... 240/2 R, 2 S, 2 SP; 200/310, 316, 317

[56] References Cited

UNITED STATES PATENTS

| | | | |
|---|---|---|---|
| 2,428,167 | 9/1947 | Linton | 240/2 SP |
| 2,612,597 | 9/1952 | Sherrard | 240/2 SP |
| 3,864,561 | 2/1975 | Spira et al. | 240/2 SP |

*Primary Examiner*—Fred L. Braun

*Attorney, Agent, or Firm*—Paul E. Rochford

[57] ABSTRACT

A dimmer device is provided with an improved illumination of its control knob. The light is transmitted to the knob from a light source such as a glow lamp positioned close to the shaft of the control knob. An opening is provided in the dimmer housing at this point so that light can pass from the dimmer to and through the conventional opening of a conventional switch plate. A plastic lens is mounted in the opening in the housing to close it against entry of dust or articles which might damage the glow lamp or the internal controls of the dimmer. The lamp is held in place at the opening in part by a portion of the internal structure of the dimmer and in part by cooperation between the lamp power supply and the lamp protecting lens.

7 Claims, 11 Drawing Figures

LIGHTED KNOB DIMMER

BACKGROUND

The present invention relates to illumination of the control knob of a dimmer device and more particularly, to the structure by which a dimmer device is reliably and economically assembled with a means for illuminating the control knob of the dimmer to a degree which permits it to be found in the dark.

It has been known for many years that in homes and other buildings where a person enters a darkened room, it is advantageous to have a minimum level of light at locations within the room where control operations are performed, and particularly the control which illuminates the room itself. Switches of the toggle mechanism variety have illuminated triggers so that one of these switch triggers appears as a point of light to a person entering an otherwise darkened room. Such switches have been known for many years and a number of patents have been issued covering such structures. U.S. Pat. Nos. such as 2,625,631 and 3,701,870 for example are concerned with switch mechanisms which have illuminated activators. Further, on equipment such as television sets, electric cooking ranges, washing machines and the like, the control mechanism of such apparatus is frequently illuminated to provide an indication that the apparatus is in the electrically active state. U.S. Pat. Nos. such as 2,732,467; 2,339,904; 2,548,760 typify the type of apparatus which have illuminated controls.

Dimmer products have appeared on the market which provide illumination of the control for a dimming device. Such articles have had glow lamps mounted beneath a dimmer knob to deliver light through a wall bracket to the underside of the dimmer knob. As is known, many dimmers have controls which are operated by two essentially independent motions. For such devices, the ON-OFF switching motion is operated by a pushing of a shaft into the dimmer device to operate a mechanism within the device and to switch the current ON or to switch it OFF. Independently of this motion, the dimmer is equipped to undergo a rotary control motion and this rotary control serves to establish the level of electric power which flows through the dimmer switch. Accordingly for such devices, it is feasible to turn some dimmers ON by their push-On, push-Off, switching motion at any lighting level to which the rotary control knob happens to be turned when the ON-OFF switch is activated. Alternatively an ON-OFF activation may be incorporated in a purely rotary switch at the end of the rotary control motion of the control knob and its associated control shaft.

A problem which relates to the illumination of many dimmer devices is that the control element is a rather substantial knob which is spaced from the switch housing at the end of the control shaft, and the shaft undergoes both reciprocal in and out motion and rotary lighting level control motion. Accordingly, the control element of such dimmers is substantially larger than the conventional toggle trigger which protrudes through the switch plate opening of the conventional switch structures and wall plate structures.

Another problem which concerns the illumination of the dimmer control mechanism is that the structure within the dimmer apparatus itself is quite complex when compared for example, to the conventional ON-OFF switch. There is a circuit in the dimmer housing which is the control circuit for the dimmer and this is the circuit which is operated by the manipulation of the control knob. Typical patents which describe the internal structure of such switches are U.S. Pat. No. 3,103,618 and others.

OBJECTS OF THE INVENTION

It is one object of the present invention to provide a dimmer switch which has an improved illuminated control mechanism.

Another object is to provide a dimmer switch in which the control of the switch is safely illuminated and in which the illumination means does not interfere with the operation of the switch.

Another object is to provide an illumination mechanism for a dimmer switch which permits improved illumination of the control thereof.

Another object is to provide an assembly for an illuminated dimmer switch which is both economical and highly reliable in operation.

Another object is to provide the relatively simple mechanism by which illumination of the control element of a dimmer may be achieved.

Other objects and advantages of the present invention will be in part apparent and in part pointed out in the description which follows.

SUMMARY OF THE INVENTION

One way in which the invention may be carried out is by providing a dimmer structure having a mounting bracket and having an insulating housing attached to the mounting bracket for mounting of the bracket and housing in a conventional wall box to provide dimming control. A window is provided in the mounting bracket proximate an opening for a control shaft. The window is provided in an area which is normally partially covered by a switch wall plate mounted over the bracket. A trigger opening of the switch wall plate is that in which the trigger of a toggle mechanism operates and is standard for switch wall plates. Internally a light source is connected to the power terminals of the switch through a resistor where necessary. The light source itself is held in place in the window at least partially by the internal structure of the dimmer switch. Externally of the light source a light transmitting lens is disposed in the window and over the light source to prevent damage to and to permit passage of light from the light source. The lens is also employed to prevent objects being introduced through the mounting bracket to the interior of the dimmer switch mechanism.

DESCRIPTION OF THE PREFERRED EMBODIMENT

The lighted knob dimmer provided pursuant to this invention involves the transmission of light through the conventional trigger opening of a conventional switch plate. It is known that practically all switch plates are designed for use with toggle mechanism switches. Such switch plates are constructed so that the trigger may be moved to its ON and OFF positions without interference from the switch plate mounted on the switch. The switch itself is conventionally mounted in turn within a wall box.

Figure 2:
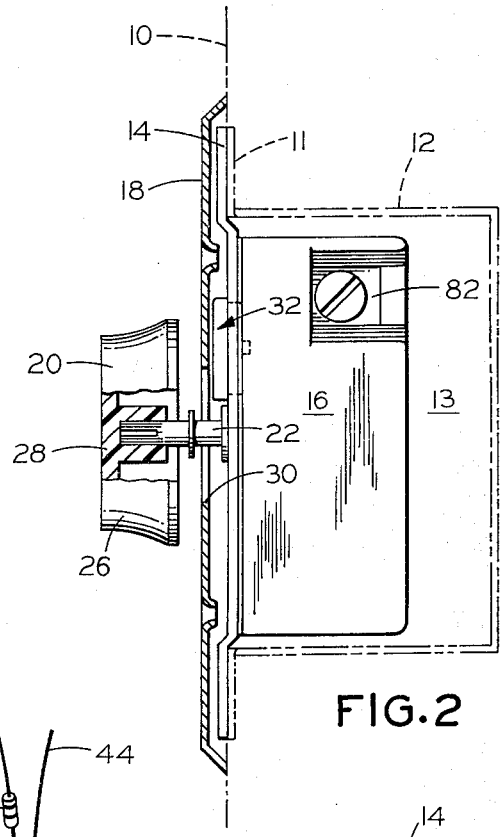
FIG. 2 is a side elevation, in part in section, of an enlarged version of the dimmer shown in FIG. 1.

This conventional mounting of a switch within a wall box is illustrated, for example, in FIG. 2 where the wall 10 and wall box 12 are indicated in skeletal outline. A mounting bracket 14 of a dimmer corresponding in important general dimensions to the mounting bracket of most ordinary switches, is preferably held in contact with the exterior wall surface 10.

The switch housing, in this case a dimmer switch housing 16, is held by the mounting bracket in the recess 13 defined by the wall box 12. A switch plate 18 which may have conventional dimensions fits over the mounting bracket 14. The plate extends beyond the bracket, above, below, and at the sides to provide in effect a visual shield for the mounting bracket 14 and other elements of the mounted switch and wall box. A dimmer knob 20 is held in place, spaced from the plate 18, by a shaft 22 extending from the interior of the switch housing 16 through a shaft opening 24 in the mounting bracket 14.

The knob 20 is mounted by a conventional pressure fit of a central splined well on a splined end of the shaft 22 as best illustrated on FIG. 2. The knob 20 is preferably made of a transparent or translucent material and may have a skirt-type gripping surface 26 extending inwardly toward the wall plate 18 from an outer disc 28. Light passing through the conventional rectangular trigger opening 30 in wall plate 18 will pass in turn through the skirt 26 and plate 28 of the knob 20 to the eye of the beholder. The mechanism of the present invention is designed in part to provide a protected source of light at trigger opening 30 of switch plate 18 to pass to the beholder through any transparent or semi-transparent portion of knob 20.

The protected source of light which can produce this lighted knob effect is housed at the surface of the mounting bracket 14 of the dimmer beneath a protecting lens element 32 mounted on and supported by the bracket 14 of the dimmer. A principal feature of the present invention is the manner in which elements are combined to support and protect a lamp or light source in a position close to and adjoining the control shaft 22 of the dimmer and adjacent to the trigger opening 30 of switch plate 18.

Another feature of the present invention involves the combining of lighting and support elements to provide a uniquely economical, reliable and safe supply of lighting for a transparent or semi-transparent knob element sufficient to permit the mounted dimmer to be found by a prospective user in a darkened or semi-darkened room. The manner in which this supply of light is achieved is explained now with reference again to the drawing.

Figure 1:
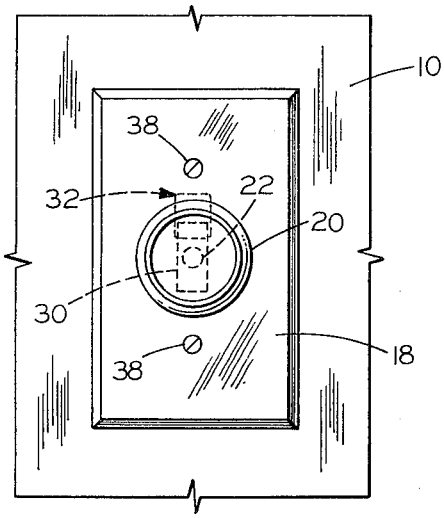
FIG. 1 is a front elevation of a switch plate and a dimmer assembly shown as they appear in a wall.

With reference first to FIGS. 1 and 2, as indicated above the figures illustrate an area of a wall 10 having a conventional switch plate 18. A shaft 22 is mechanically interlocked with the dimmer mechanism within a dimmer housing 16 to provide suitable control responsive to the manipulation of the dimmer knob 20. The relationship of the switch plate trigger opening to the dimmer knob 20 is illustrated by the dashed outline 30 of FIG. 1. The relationship of the lens 32, in which the light source is enclosed, to the trigger opening is illustrated by the dashed outline 32. It is evident that the lens 32 lies in part beneath the switch plate opening 30.

A portion of the light which passes through lens 32 will pass in turn through the switch plate opening 30. After passing through the opening 30, the light will pass through the semi-transparent or transparent knob 20 mounted over the switch plate opening 30. A shaft on which the control knob 20 is mounted is illustrated by the dashed line 22 of FIG. 1.

Figure 3:
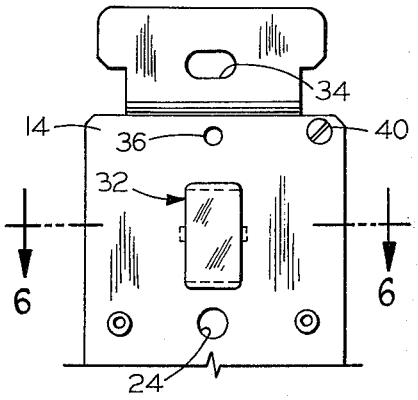
FIG. 3 is a front elevation of part of the dimmer of FIGS. 1 and 2 with the switch plate and dimmer knob removed.

A more detailed view of the spacial relationship between a lens 32, a mounting bracket 14, and a shaft opening 24, through which a control shaft extends from the dimmer interior, is presented in FIG. 3. The bracket 14 has the conventional unthreaded screw holes 34 through which mounting screws extend to mount the dimmer by its bracket 14 to a wall box such as box 12 of FIG. 2. A threaded screw hole 36 formed in the bracket 14 receives the wall plate mounting screws 38. The corner screw 40 is an assembly screw for assembly of the mounting bracket 14 to the insulating housing 16 of the dimmer.

Figure 5:
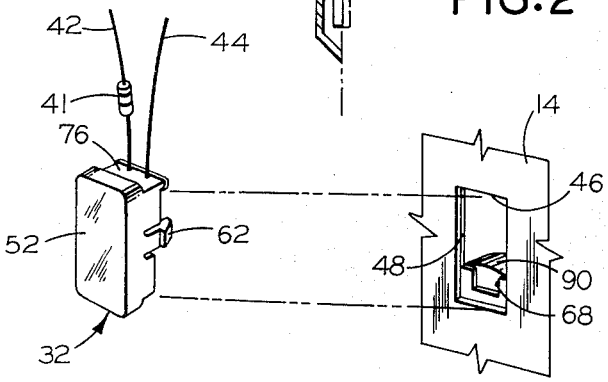
FIG. 5 is an exploded perspective view showing some further details of the window and light source arrangement of the dimmer of FIGS. 1 and 2.

In FIG. 5, the pre-assembly spacial relationship between lens element 32 and its associated parts, and the wall bracket 14 are illustsrated. The mounting bracket 14 has a window opening 46 in the face of the bracket and the opening 46 is illustrated in the exploded view of FIG. 5 in a position to receive lens 32. Considering first the lens 32 and its related elements, the lens itself is preferably a molded plastic element having an external face 52 with end flanges 54 and 56. The end flanges butt at their respective shoulders 58 and 60 against the outer end surfaces of opening 46 of bracket 14 when the lens is assembled to bracket 14. The lens 32 is held in a mounted position in opening 46 by a pair of spring latches 62 and 64 formed integrally with the lens 32 at side portions thereof. The latches 62 and 64 are latched to internal surfaces of the dimmer by being introduced into and pressed through the opening 46 in mounting bracket 14 of the dimmer.

Figure 6:
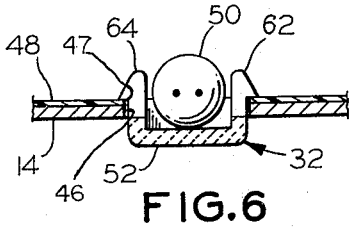
FIG. 6 is a detailed portion of a horizontal section taken along the line 6—6 of FIG. 3 illustrating the window and lamp arrangement in relation to the mounting bracket.
Figure 7:
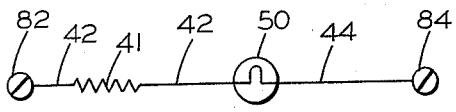
FIG. 7 is a schematic wiring diagram illustrating an electrical arrangement of a light source and resistor with wire terminals connectable to a source of electric power.

As seen in FIGS. 5 and 6, the bracket 14 is backed up by an insulating plate 48 having an opening 47 conforming generally to the opening 46 of bracket 14. In FIG. 6, the lens 32 is shown in its latched position with the latches 62 and 64 bearing against insulating plate 48. Also in FIG. 6, the nesting of the light source 50 in the well of the lens 32 is made clear.

Figure 8:
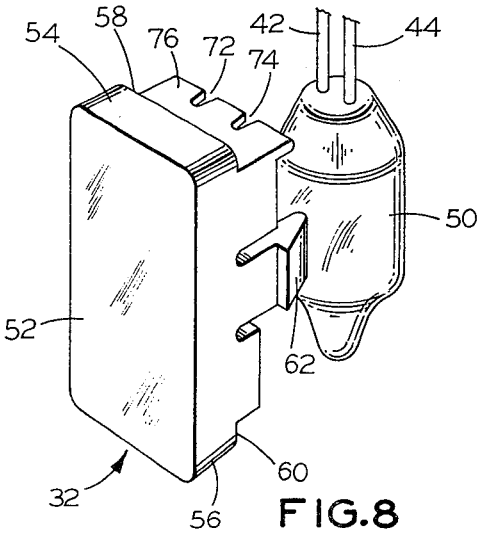
FIG. 8 is a perspective view of a further detail of a lens and lamp as employed in the dimmer of the present invention.
Figure 9:
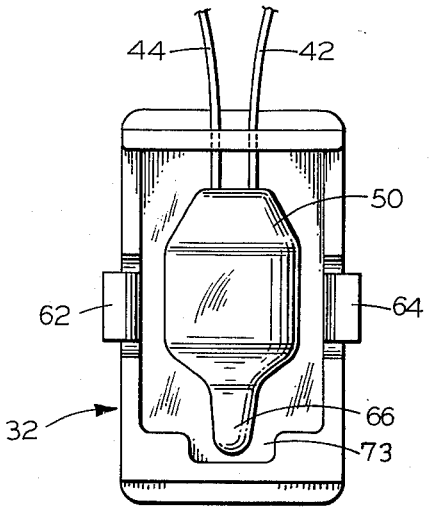
FIG. 9 is a rear elevation of the assembled lamp and lens combination.
Figure 10:
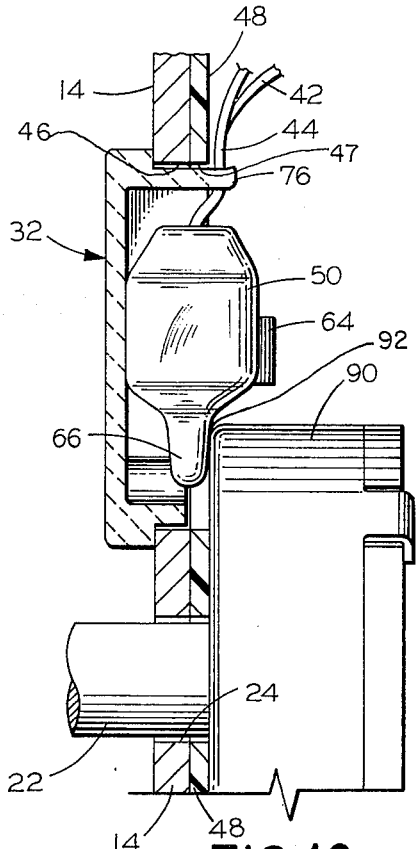
FIG. 10 is a detailed side elevational view, in part in section, of the lamp and lens combination of elements illustrated in their relation to the mounting bracket and internal parts of a dimmer.

The retention of light source 50 which may preferably be a glow lamp within the lens well is insured by the mounting of the lamp by its power supply leads into an end wall 76 of the lens 32. Also, insulating separation of the electrical leads supplying electric power to the lamp is insured by this same mounting of the lamp leads in end wall 76. The manner in which this mounting is accomplished is illustrated in FIGS. 5 and 8. By comparison of the upper portions of the lens 32 as illustrated in FIG. 5 with the same portions of the lens illustrated in FIG. 8, it is evident that the lamp has two electric leads 42 and 44 extending from one end of the lamp 50 and that these leads can be made captive in one end surface of the lens. The electric leads 42 and 44 are separated pursuant to this invention and introduced into the notches 72 and 74 of the upper inner end 76 of lens 32. After the wires 42 and 44 are placed in the notches 72 and 74, the plastic of the lens is heated to upset it as illustrated in FIGS. 5, 9, and 10 and to deform plastic around the electric leads to lock them into place in the insulating end 76 of the lens 32. The lens 32 with the light source 50 mounted therein and held therein by electric leads 42 and 44, and including the resistor 41 where needed to control power to the light source, constitutes a sub-assembly of the article of the present invention. This sub-assembly may be preformed and prepared for insertion into and may be mounted in the lighted knob dimmer article of this invention.

In order to assemble the sub-assembly including the resistor, lead wires, lamp, and lens to the dimmer housing, the lamp is first placed within the hollow back of the lens and the leads are then inserted into the notches 72 and 74. Next the plastic of the end 76 of the lens is heat deformed to lock conductors into the notches 72 and 74. The sub-assembly is then ready for insertion into the dimmer unit.

Figure 4:
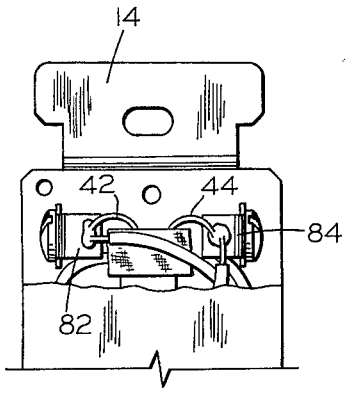
FIG. 4 is a back elevation in part cut away of the dimmer of FIG. 3 illustrating part of the internal structure of a dimmer.

To accomplish this assembly, the two lead wires 42 and 44 and resistor 41 are first introduced through the openings 46 and 47 in the mounting bracket 14 and the insulating backing layer 48 respectively. Then the lens is aligned with the opening and pressed into place to bring the spring latches 62 and 64 into their engaged position as illustrated in FIG. 6. The actual connection of the electrical leads 42 and 44 to current supply portions of the dimmer after the above assembly has been completed is accomplished by the soldering of the leads 42 and 44 to appropriate electrical contacts within the dimmer article. A dimmer in which the leads have been soldered is shown in FIG. 4 where the leads 42 and 44 are soldered to screw terminal 82 and 84, respectively. These screw terminals are the terminals to which power supply wires to the dimmer are fastened by means of their respective screws.

One additional feature of the construction of the article of the present invention is that the light which supplies illumination to the knob is held in position and secured not only by the lens and the entrappment of the wires at the end surface of the lens but, in addition, the light is held and secured in place by other elements of the internal structure of the dimmer. With particular reference to FIG. 10 there is shown, in part in section, a vertical elevation through a portion of the dimmer where the light source and lens are located. The lens itself is snapped into place as explained above so that the electrical leads 42 and 44 extend from the upper end 76 of the lens and the wires are thus proximate the insulated inner insulating layer 48. The opposite end of the lamp is held in place by the disposition of internal structure of the dimmer over the end portion of the lamp. In the particular case shown in FIG. 10, an edge 92 of a potentiometer 90 is shown to bear against and to hold in place the lower end or tip 66 of glow lamp 50.

The relation of the potentiometer 90 to the openings 46 and 47 in the metal bracket 14 and insulating layer 48 of the dimmer is evident from FIG. 5 where the potentiometer may be seen through the openings and where a notch 68 in the insulating layer 48 may be seen to provide a nesting seat for the tip 66 of the lamp once the parts are assembled together. This notch-type formation is also present in the lens itself where a notch 73 (FIG. 9) is formed at the lower end of the lens to receive tip 66 of lamp 50.

It is evident from FIG. 10 that the glow lamp itself is actually located about in the plane of the portion of the bracket 14 itself which was removed in forming window 46. Accordingly the amount of light emitted from the dimmer interior is substantial when measured in terms of the light which can pass through the window in the dimmer and which can accordingly pass through and from the lens 32. Further there is correspondingly a relatively high proportion of the light emitted from the lamp which can and which does pass through a trigger opening 30 of a switch plate mounted over the lighted knob dimmer of this invention.

Another form of the device in which the advantage of higher light emission is made available is the form in which the shaft of the dimmer is not precisely centered on the mounting bracket but is displaced slightly off center and along the longitudinal axis of the mounting plate. Where the shaft is moved slightly off center, then the placement of the light can be more central with respect to the trigger opening of a wall plate over the dimmer and accordingly over the bracket of the dimmer. Where the dimmer control shaft is off center and where the light source is more centrally located beneath the trigger opening of a switch plate as compared with the embodiment discussed and illustrated in FIG. 1, then a greater level of light is transmitted through the switch plate opening and the knob receives a greater level of light. This form of the device of this invention is particularly valuable where a higher level of illumination is desired or required.

Figure 11:
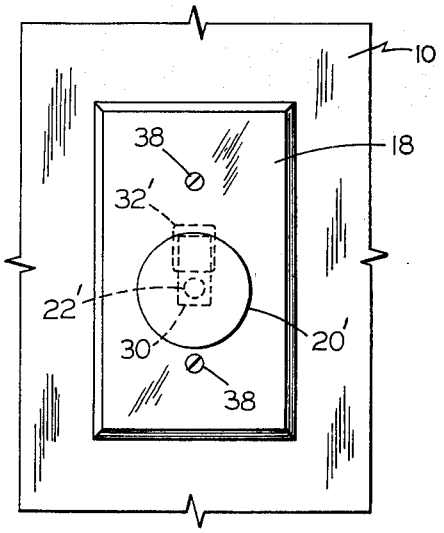
FIG. 11 is a front elevational view similar to that of FIG. 1 but illustrating a different relationship of the shaft and light source to the trigger opening of the switch wall plate.

A dimmer having this combination of off-center shaft and more centered light source and lens is illustrated in FIG. 11. In the device of FIG. 11, the parts having numerals the same as those given in FIG. 1 are essentially the same as those described with reference to FIG. 1. The parts labelled with primed numerals are similar to those described in reference to FIG. 1.

With specific reference to FIG. 11, the section of wall 10 has a dimmer (not shown) mounted in a wall box (not shown) and has a switch plate 18 mounted over the enclosed dimmer and secured thereto by screws 38. A dimmer shaft 22′ is off center with reference to the switch plate trigger opening 30 and is particularly positioned to extend through a lower end of opening 30. A lens 32′ is positioned over the opening in the dimmer bracket as described above but the opening in the dimmer bracket is positioned to reside principally under and behind the trigger opening 30 in the switch plate itself. Improved light emission to and through dimmer knob 20' results.

Another desirable feature of the article of the present invention is the freedom of the device from problems growing out of having an opening in the mounting bracket through which entry may be gained to the dimmer interior. One such problem of course is the entry of some article which may disturb the electrical system within the dimmer, as for example, a wire or hairpin or the like. Another problem is the entry of dust or other contaminants which may settle on moving parts of the dimmer and cause additional wear or disturb the proper operation of the moving parts. Because the article of the present invention utilizes a lens closure for the light transmitting opening in the dimmer bracket, there is no danger from the inadvertant or mischievous entry of articles through any opening in the bracket. Further, the closure article serves other functions in the combination which is provided by this invention. The other functions include the maintainence of the light source in a most advantageous position as well as the function of separating and insulating the power supply wires extending from screw terminals of the dimmer to the lamp.

Further because a lens is combined with the light source and with the dimmer knob, it is feasible to adjust and predetermine the light transmission properties of these elements in combinations as to degree of transparency and translucency to provide a desired or most effective level of light for uses of the device. For example where detecting and viewing the lighted condition of the knob in a lighted room is desired, the lens transparency can be adjusted to produce this effect. Where by contrast the level of lighting is desired so the knob is seen as lighted only in a semi-darkened room, the degree of transparency can be reduced so that this lower level of lighting is achieved.

What is claimed and desired to be secured by Letters Patent of the United States is:

1. A lighted knob dimmer comprising:

a. a dimmer having an insulating housing and a metal mounting bracket affixed to the housing for mounting the dimmer in a wall box, b. the mounting bracket of said dimmer having located generally centrally thereof a control shaft capable of rotary motion to adjust the power level transmitted through said dimmer, c. an opening through said mounting bracket adjacent said control shaft, d. a light source in said opening, e. said light source being restrained from movement through said opening by a lens member covering said bracket opening, f. said light source being at least partially restrained from movement away from said lens member by abutment against a component element of said dimmer, g. and said metal mounting bracket is backed by an insulating layer and wherein the opening through the mounting bracket extends also through the insulating layer.

2. The lighted knob dimmer of claim 1 wherein the center of said light source lies substantially in the plane defined by said insulating layer backing said mounting bracket.

3. The lighted knob dimmer of claim 1, wherein the light source is a glow lamp.

4. The lighted knob dimmer of claim 1, wherein electric leads from the light source are insulatedly separated by embeddment in a wall portion of the lens member.

5. The lighted knob dimmer of claim 1, in which the lens member is provided with integrally formed spring latches and the lens member is held in said bracket opening by said latches.

6. The lighted knob dimmer of claim 1, in which the shaft is off center relative to the bracket center in a direction along the longitudinal axis of the dimmer bracket and wherein a portion of the light source lens member is located centrally of the mounting bracket.

7. The lighted knob dimmer of claim 1, in which the lamp and lens member are held together and in place in said dimmer by a potentiometer edge mounted about the shaft where said shaft extends into said dimmer.

* * * * *